US011591788B2

(12) United States Patent
Klein

(10) Patent No.: US 11,591,788 B2
(45) Date of Patent: Feb. 28, 2023

(54) Z-SHAPED ATTACHMENT ELEMENT FOR BUILDING CONSTRUCTION

(71) Applicant: James Alan Klein, Bellevue, WA (US)

(72) Inventor: James Alan Klein, Bellevue, WA (US)

( * ) Notice: Subject to any disclaimer, the term of this patent is extended or adjusted under 35 U.S.C. 154(b) by 0 days.

(21) Appl. No.: 17/363,324

(22) Filed: Jun. 30, 2021

(65) Prior Publication Data

US 2023/0003012 A1 Jan. 5, 2023

(51) Int. Cl.

| | |
|---|---|
| ***E04B 1/24*** | (2006.01) |
| ***E04B 1/08*** | (2006.01) |
| ***E04B 1/76*** | (2006.01) |
| ***B21D 35/00*** | (2006.01) |
| ***B21D 47/00*** | (2006.01) |

(52) U.S. Cl.

CPC ..... *E04B 1/2403* (2013.01); *B21D 35/001* (2013.01); *B21D 47/00* (2013.01); *E04B 1/08* (2013.01); *E04B 1/76* (2013.01); *E04B 2001/2415* (2013.01); *E04B 2001/2454* (2013.01)

(58) Field of Classification Search

CPC . E04B 1/2403; E04B 1/08; E04B 1/76; E04B 2001/2415; E04B 2001/2454; B21D 35/001; B21D 47/00

See application file for complete search history.

(56) References Cited

U.S. PATENT DOCUMENTS

| | | | | | |
|---|---|---|---|---|---|
| 3,585,697 | A * | 6/1971 | Butler | B29C 69/00 | 29/6.2 |
| 3,979,537 | A * | 9/1976 | Troyer | B32B 5/24 | 52/404.1 |
| 4,152,873 | A * | 5/1979 | Burke | E04B 2/78 | 52/842 |
| 4,329,824 | A * | 5/1982 | Lowe | E04C 3/07 | 52/840 |
| 4,409,771 | A * | 10/1983 | Lowe | E04C 3/07 | 52/840 |
| 4,490,958 | A * | 1/1985 | Lowe | E04C 3/07 | 52/840 |
| 4,584,811 | A * | 4/1986 | Balinski | E04C 3/293 | 52/745.12 |
| 4,896,818 | A * | 1/1990 | Shteinbok | E04C 3/086 | 228/171 |

(Continued)

*Primary Examiner* — Rodney Mintz
(74) *Attorney, Agent, or Firm* — Thomas E. Loop

(57) ABSTRACT

A Z-shaped attachment element for use in building construction is disclosed. The Z-shaped attachment element is made from a single piece of sheet metal that is first cut and then bent to form the Z-shaped cross-sectional profile. The Z-shaped attachment element comprises: an elongated upper flange; an elongated lower flange, wherein the upper and lower flanges are spaced apart and substantially parallel to each other; an elongated middle web section between, and connected to, the upper and lower flanges along respective upper and lower lengthwise bends (wherein the middle web section is diagonal in relation to the position of the upper and lower flanges, thereby defining a generally Z-shaped cross-sectional profile); and a plurality of notches formed along the lower lengthwise bend and into the lower flange and the adjoining middle web section, but not into the upper bend or the upper flange, of the Z-shaped sheet metal attachment element.

4 Claims, 2 Drawing Sheets

(56) References Cited

U.S. PATENT DOCUMENTS

| | | | | |
|---|---|---|---|---|
| 4,918,879 | A * | 4/1990 | Bodurow | E04B 1/6183 52/277 |
| 5,133,718 | A * | 7/1992 | Mao | A61B 17/80 606/280 |
| 5,157,887 | A * | 10/1992 | Watterworth, III | E04C 5/065 52/340 |
| 5,953,875 | A * | 9/1999 | Harkins | E04B 1/62 52/273 |
| 7,152,385 | B2 * | 12/2006 | Morgan | E04D 13/1656 52/317 |
| 9,359,767 | B2 * | 6/2016 | Glick, Jr. | E04D 13/174 |
| 9,441,371 | B1 * | 9/2016 | Harkins | E04B 7/18 |
| 9,580,912 | B1 * | 2/2017 | Harkins | E04B 9/306 |
| 9,605,435 | B2 * | 3/2017 | Glick, Jr. | E04D 13/174 |
| 11,045,858 | B2 * | 6/2021 | Zalduegui | B23K 26/38 |
| 2011/0214371 | A1 * | 9/2011 | Klein | E04C 3/28 52/232 |
| 2016/0069082 | A1 * | 3/2016 | Glick, Jr. | E04D 13/174 52/90.2 |
| 2017/0037634 | A1 * | 2/2017 | Glick, Jr. | E04D 13/174 |
| 2017/0234010 | A1 * | 8/2017 | Klein | E04B 2/7457 52/846 |
| 2020/0156137 | A1 * | 5/2020 | Zalduegui | B23K 26/38 |
| 2021/0146423 | A1 * | 5/2021 | Zalduegui | B23P 13/02 |

* cited by examiner

Z-SHAPED ATTACHMENT ELEMENT FOR BUILDING CONSTRUCTION

TECHNICAL FIELD

The present invention relates generally to building construction systems and, more particularly, to building construction framing elements and related methods that facilitate the construction of fire-rated wall assemblies within a building.

BACKGROUND OF THE INVENTION

In the building construction industry, the construction of fire-rated wall assemblies within a building is an important construction detail that, if properly and compliantly done, promotes life safety (namely, by preventing and/or by reducing the spread of fire and smoke in the event of a building fire).

Nowadays, there are two primary methods used for sealing linear junctions (e.g., head-of-wall joints and expansion joints) against the spread of fire and smoke; namely, by (1) applying a firestop intumescent sealant (in the form of either a caulk, tape, or spray) along and into the linear joint, or (2) installing a specialty track (and/or other suitable specialty framing member) that has had a pre-applied intumescent tape appropriately placed on the track/framing member (such that the intumescent tape seals the linear construction joint). These two methods are widely used and both have been tested and certified by Underwriter Laboratories, Inc. ("UL" is an independent worldwide testing and regulatory compliance certification organization) as being compliant with certain specified fire and hose stream UL test standards.

For example, UL has tested and certified various building construction "joint systems" in accordance with their testing standards set forth in "UL 2079 Tests for Fire Resistance of Building Joint Systems, fifth edition (Aug. 26, 2015)." These enhanced UL fire test standards apply to a large number of building construction joint systems (and related wall assemblies) of various materials and construction. UL's joint system fire tests evaluate the length of time that a specified joint system will contain a fire during a predetermined/controlled exposure to fire. Consequently, UL's joint system fire tests evaluate the joint system's resistance to heat and, in some instances, to a hose stream, while carrying an applied load (if the assembly is load bearing). UL's joint system fire tests may, in some instances, include an air leakage test to determine the rate of air leakage through joint systems resulting from a specified air pressure difference applied across the surface of the joint system.

In the building construction industry, metal framing assemblies are commonly used to construct commercial and residential buildings. Metal framing assemblies are generally constructed from a plurality of metal framing members including studs, joists, trusses, and other metal posts and beams (e.g., I-beams) formed from sheet metal (and frequently fabricated to have the same general cross-sectional dimensions as standard wooden members used for similar purposes). Metal framing members are typically constructed by either brake-pressing or roll-forming (with both methods being referred to as "cold-formed" processing) 12-to-24-gauge galvanized sheet steel. Although many cross-sectional shapes are available, the primary shapes used in building construction are C-shaped studs and U-shaped tracks. For example, most wall assemblies are constructed from U-shaped tracks fastened to the floor (footer) and ceiling (header) with a plurality of C-shaped studs laterally spaced apart, and vertically positioned between, the opposing header and footer tracks. The sealing of perimeter and head-of-wall linear joints is an important aspect of building construction because a robust and effective seal can impede and/or prevent the spread of fire and smoke.

Although some progress has been made in recent years, there is still a need in the art for new and improved building construction products that better promote life safety—including innovative building construction products that facilitate the construction of head-of-wall assemblies, which, in turn, better seal linear construction joints (for purposes of impeding the transmission of fire and smoke in the event of a building fire, and/or impending the transmission of sound from one room to another). In particular, there is a need in the art for new and improved devices and methods that facilitate the attachment of a header track to an overhead beam that as has been sprayed and encrusted with a fire-proofing and/or insulation material. The present invention fulfills these needs and provides for further related advantages.

SUMMARY OF THE INVENTION

In brief, the present invention in an embodiment is directed to a Z-shaped attachment element for use in building construction. The inventive Z-shaped attachment element is made from a single piece of sheet metal that is first cut (e.g., die cut to form a plurality of lengthwise holes) and then bent to form the Z-shaped cross-sectional profile (wherein the plurality of holes defines a plurality notches sized and configured to receive the head of a fastening tool). The Z-shaped attachment element comprises: an elongated upper flange; an elongated lower flange, wherein the upper and lower flanges are spaced apart and substantially parallel to each other; an elongated middle web section between, and connected to, the upper and lower flanges along respective upper and lower lengthwise bends (wherein the middle web section is diagonal in relation to the position of the upper and lower flanges, thereby defining a generally Z-shaped cross-sectional profile); and a plurality of notches formed along the lower lengthwise bend and into the lower flange and the adjoining middle web section, but not into the upper bend or the upper flange, of the Z-shaped sheet metal attachment element.

In another embodiment, the present invention is directed to a building assembly comprising, in combination, a Z-shaped attachment element as described above, wherein the upper flange of the Z-shaped attachment element has been attached to an overhead beam within a building, and wherein a fire-proofing or insulation material has been applied thereon, and wherein the fire-proofing or insulation material has been substantially removed from the lower surface of the lower flange of the Z-shaped attachment element.

In yet another embodiment, the present invention is directed to a method of a making a Z-shaped attachment element for use in the construction of a building. The inventive method involves cutting and bending a single piece of sheet metal.

These and other aspects of the present invention will become more evident upon reference to the following detailed description and accompanying drawings. It is to be understood, however, that various changes, alterations, and substitutions may be made to the specific embodiments disclosed herein without departing from their essential spirit or scope.

BRIEF DESCRIPTION OF THE DRAWINGS

The drawings are intended to be illustrative and symbolic representations of certain exemplary embodiments of the present invention, and as such they are not necessarily drawn to scale. In addition, it is to be expressly understood that the relative dimensions and distances depicted in the drawings are exemplary and may be varied in numerous ways. Finally, like reference numerals have been used to designate like features throughout the different views of the drawings.

DETAILED DESCRIPTION OF INVENTION

Figure 1:
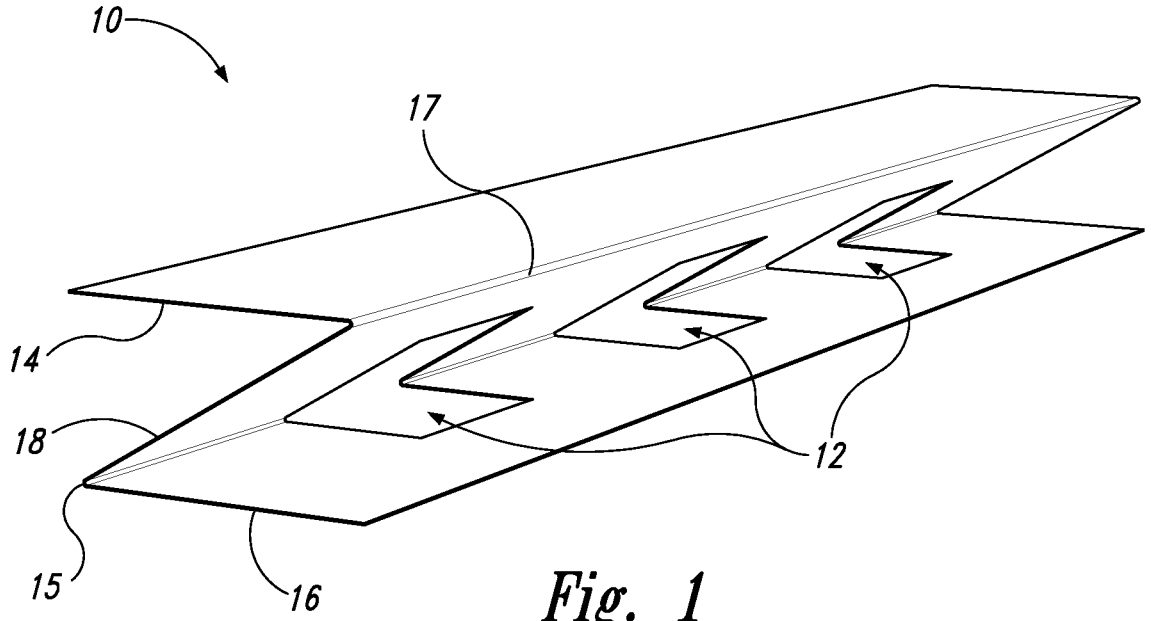
FIG. 1 shows a perspective view of a sheet metal Z-shaped attachment element in accordance with an embodiment of the present invention.

In the following detailed description, reference is made to the accompanying drawings, which form a part hereof. In the drawings, similar symbols or markings have been used to identify like or corresponding elements, unless context dictates otherwise. The illustrative embodiments described in the detailed description, drawings, and claims are not meant to be limiting. Other embodiments may be utilized, and other changes may be made, without departing from the spirit or scope of the invention disclosed herein.

Figure 2:
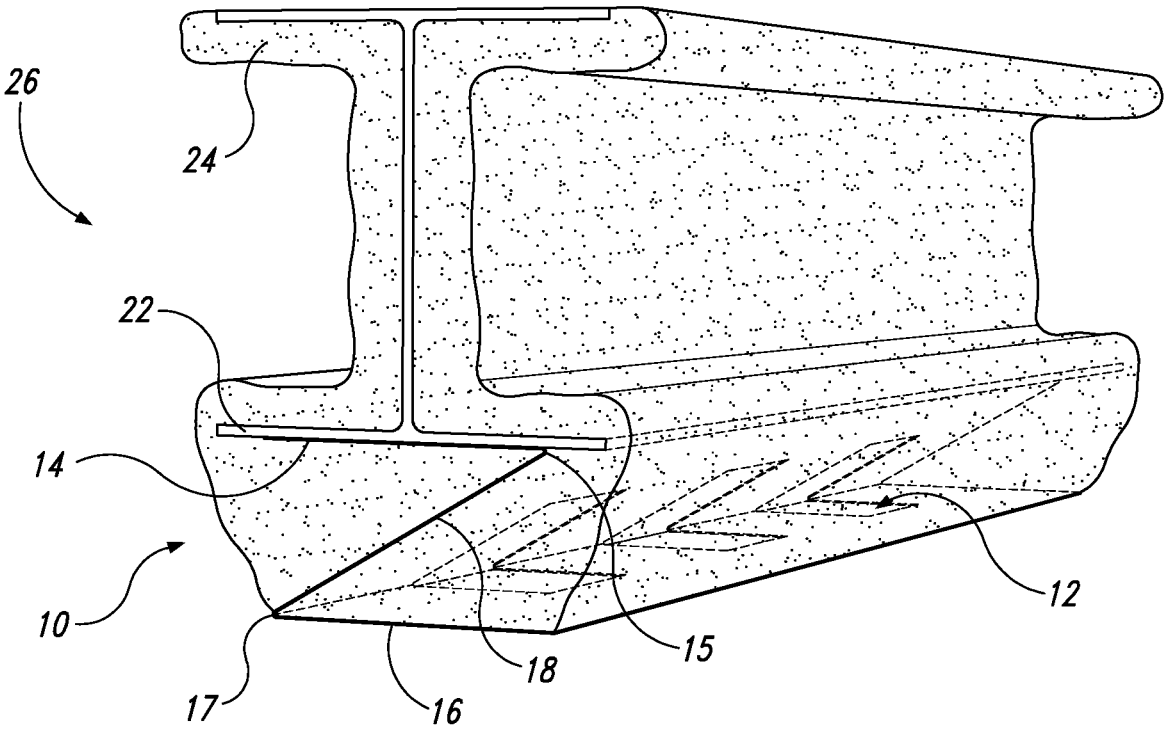
FIG. 2 shows a perspective view of a sheet metal Z-shaped attachment element attached to and overhead I-beam, and wherein a fire-proofing or insulation material has been applied thereon, and wherein the applied fire-proofing or insulation material has been substantially removed from the lower surface of the lower flange of the Z-shaped attachment element in accordance with an embodiment of the present invention.
Figure 3:
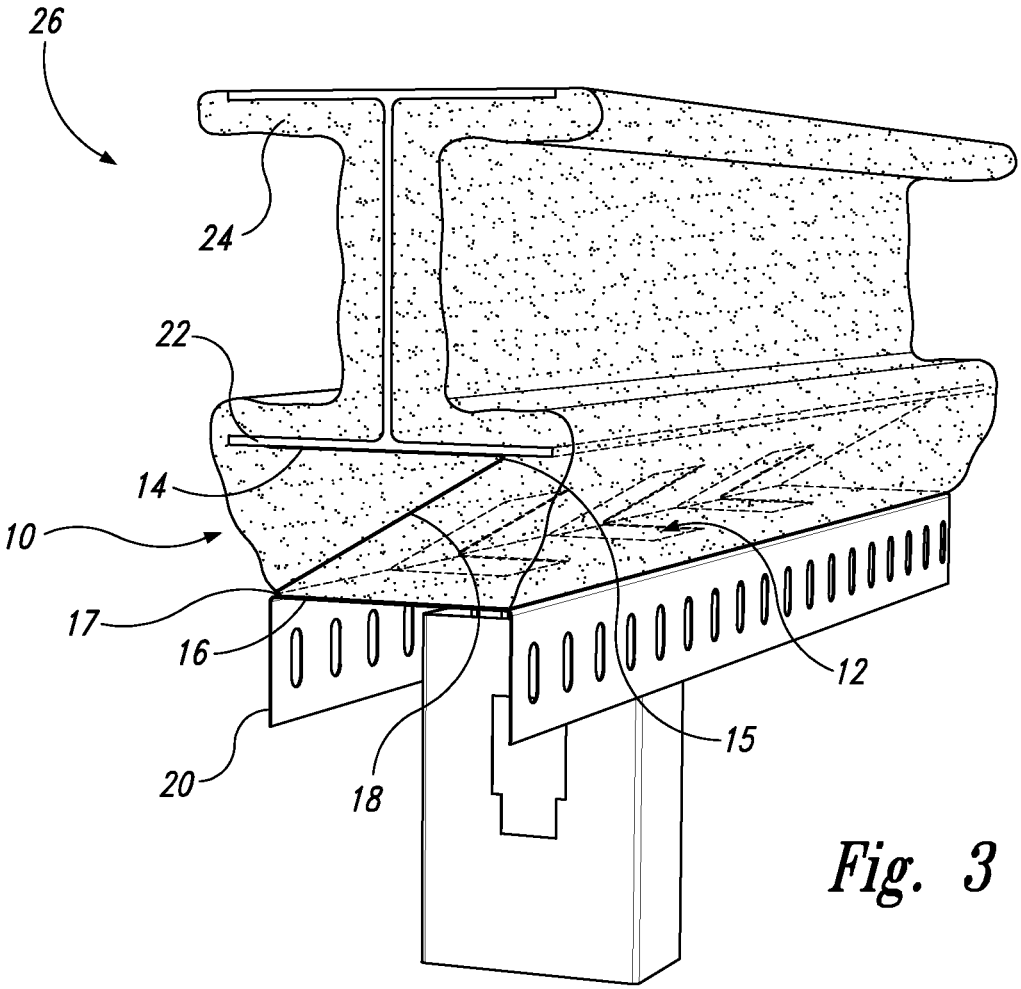
FIG. 3 shows a perspective view of the sheet metal Z-shaped attachment element attached to an overhead I-beam having fire-proofing and/or insulation material applied thereon as shown in FIG. 2, wherein a sheet metal U-shaped header track has been attached to the lower surface of the lower flange of the Z-shaped attachment element (as part of a wall assembly made from U-shaped tracks and C-shaped studs) in accordance with an embodiment of the present invention.

Accordingly, and as best shown in FIG. 1-3 (showing preferred embodiments), the present invention in an embodiment is directed to a Z-shaped attachment element 10 for use in building construction. The inventive Z-shaped attachment element 10 is used to facilitate the attachment of a header track 20 to an overhead beam 22 that as has been sprayed and encrusted with a fire-proofing and/or insulation material 24. The inventive Z-shaped attachment element 10 is preferably made from a single piece of sheet metal (e.g., 12-to-24-gauge steel) that is both elongated and rectilinear. More specifically, the single piece of sheet metal (used to make the Z-shaped attachment element 10) is (1) first cut (e.g., die cut) to form a plurality of holes 12 (e.g., rectangular holes) lengthwise along, and within the interior of, the piece of sheet metal, and (2) then bent lengthwise two times to form the Z-shaped cross-sectional profile (having a plurality of holes that now define notches 12) that constitutes the Z-shaped attachment element 10 of the present invention.

As shown, the Z-shaped attachment element 10 comprises an elongated upper flange 14 and an elongated lower flange 16, wherein the upper and lower flanges 14, 16 are spaced apart and substantially parallel to each other. In addition, an elongated middle web section 18 is between, and connected to, the upper and lower flanges 14, 16 along respective upper and lower lengthwise bends 15, 17. The middle web section 18 is diagonal in relation to the position of the upper and lower flanges 14, 16, thereby defining a generally Z-shaped cross-sectional profile (which profile, in turn, imparts flexibility and springiness to the Z-shaped attachment element 10—especially when attached to an overhead beam 22). The interior angles formed between the middle web section 18 and the upper and lower flanges 14, 16 are preferably about the same and between the range of about 15° to about 60°. In addition, and as shown, the upper and lower flanges 14, 16 have widths that are substantially equal to each other, and wider than the width of the middle web section 18.

Upon lengthwise bending of the single piece of sheet metal two times after cutting, a plurality of notches 12 are formed along the lower lengthwise bend 15 and into the lower flange 16 and the adjoining middle web section 18, but not into the upper bend 17 or the upper flange 14, of the Z-shaped sheet metal attachment element 10. The notches 12 are sized and configured to receive the head of a fastening tool (such as, for example, a rivet gun) to thereby facilitate the attachment of the Z-shaped sheet metal attachment element 10 to an overhead beam 22.

In another embodiment, and as best shown in FIGS. 2 and 3, the present invention is directed to a building assembly 26 comprising, in combination, a Z-shaped attachment element 10 as described above, wherein the upper flange 14 of the Z-shaped attachment element 16 has been attached (via fasteners—not shown) to an overhead beam 22 (e.g., an I-beam) within a building (not shown). As shown in FIGS. 2 and 3, a fire-proofing and/or insulation material 24 has been spray applied thereon (to thereby encrust the beam 22 and adjoined Z-shaped attachment element 10 with fire-proofing and/or insulation material 24). Prior to attaching a U-shaped header track 20 to the Z-shaped attachment element 10 (which, in turn, has already been attached to an overhead beam 22), a bottom portion the fire-proofing and/or insulation material 24 is preferably substantially removed from the lower surface of the lower flange 16 of the Z-shaped attachment element 10 (by scraping the lower surface with a scraper, for example). In this way, the attachment of a header track 20 to an overhead beam 22 covered with a fire-proofing and/or insulation material 24 is facilitated (i.e., made much easier).

Figure 4:
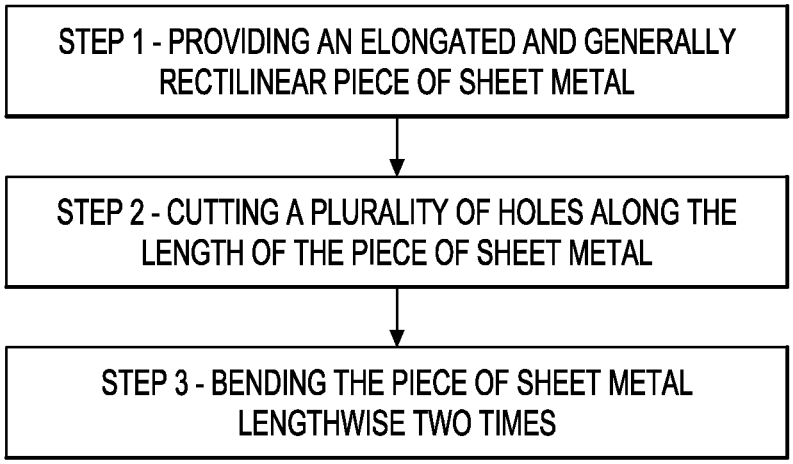
FIG. 4 is block flow diagram that shows the steps of making a Z-shaped attachment element from a single piece of sheet metal in accordance with an embodiment of the present invention.

In yet another embodiment, and as set forth in FIG. 4, the present invention is also directed to a method of a making a Z-shaped attachment element 10 for use in the construction of a building. The inventive method involves cutting and bending a single piece of sheet metal as described above. More specifically, the inventive method comprises the flowing steps: (1) step 1—providing an elongated and generally rectilinear single piece of sheet metal; (2) step 2—cutting a plurality of holes along the length of the single piece of sheet metal; and (3) step 3—bending the piece of sheet metal longitudinally two times to produce a generally Z-shaped profile that is defined by opposing upper and lower elongated flanges 14, 16 connected at upper and lower lengthwise bends 15, 17, respectively, by an interposing elongated middle web section 18 forming a plurality of notches 12 into and along the lower flange 16, the lower bend 15, and the middle web section 18, but not into the upper bend 17 or the upper flange 14, of the Z-shaped attachment element 10.

While the present invention has been described in the context of the embodiments described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. A Z-shaped sheet metal framing attachment element for use in building construction, the Z-shaped attachment element consisting essentially of:

an elongated upper flange;

an elongated lower flange, wherein the upper and lower flanges are spaced apart and substantially parallel to each other;

an elongated, adjoining middle web section between, and connected to, the upper and lower flanges along respective upper and lower lengthwise bends and defining interior angles therebetween; wherein the middle web section is diagonal in relation to the upper and lower flanges, thereby defining a substantially Z-shaped cross-sectional profile; and a plurality of notches formed along the lower lengthwise bend and extending into the lower flange and the adjoining middle web section of the Z-shaped sheet metal attachment element;

wherein the Z-shaped attachment element is a unitary structure of one-piece construction composed of a single piece of sheet metal.

2. The Z-shaped sheet metal framing attachment element of claim 1 wherein the interior angles formed between the middle web section and the upper and lower flanges are about the same and between a range of about 15° to about 60°.

3. The Z-shaped sheet metal framing attachment element of claim 2 wherein the upper and lower flanges have widths that are substantially equal to each other, and wider than a width of the middle web section.

4. A building assembly comprising, in combination, the Z-shaped attachment element according to claim 1, wherein the upper flange of the Z-shaped attachment element is attached to an overhead beam within a building, and wherein a fire-proofing or insulation material is applied thereon, and wherein the fire-proofing or insulation material is substantially removed from a lower surface of the lower flange of the Z-shaped attachment element.

* * * * *